US005629720A

United States Patent [19]

Cherry et al.

[11] Patent Number: 5,629,720

[45] Date of Patent: May 13, 1997

[54] DISPLAY MODE PROCESSOR

[75] Inventors: Robert W. Cherry, Loveland; Erin A. Handgen, Ft. Collins; Brad D. Reak, Loveland, all of Colo.

[73] Assignee: Hewlett-Packard Company, Palo Alto, Calif.

[21] Appl. No.: 427,467

[22] Filed: Apr. 24, 1995

Related U.S. Application Data

[63] Continuation of Ser. No. 39,551, Mar. 29, 1993, abandoned, which is a continuation of Ser. No. 650,513, Feb. 5, 1991, abandoned.

[51] Int. Cl.[6] ..... G09G 5/14

[52] U.S. Cl. ..... 345/119; 345/199

[58] Field of Search ..... 345/119, 118, 345/120, 121, 113, 114, 145, 150, 153, 155, 199, 186, 187, 188; 395/157, 158, 155

[56] References Cited

U.S. PATENT DOCUMENTS

| | | | |
|---|---|---|---|
| 4,559,533 | 12/1985 | Bass et al. | 340/724 |
| 4,668,947 | 5/1987 | Clarke, Jr. et al. | 340/703 |
| 4,710,806 | 12/1987 | Iwai et al. | 340/703 |
| 4,769,762 | 9/1988 | Tsujido | 340/721 |
| 4,772,881 | 9/1988 | Hannah | 340/703 |
| 4,954,819 | 9/1990 | Watkins | 340/799 |
| 5,025,249 | 6/1991 | Seiler et al. | 340/721 |
| 5,061,919 | 10/1991 | Watkins | 340/724 |
| 5,091,717 | 2/1992 | Carrie et al. | 340/703 |

OTHER PUBLICATIONS

Kurt Akeley and Tom Jermoluk, "High-Performance Polygon Rendering" Computer Graphics, vol. 22, No. 4, Aug. 1988.

*Primary Examiner*—Richard Hjerpe
*Assistant Examiner*—Xiao M. Wu

[57] ABSTRACT

A display mode processor which maps pixel inputs into addresses for entries in window-specific color look-up tables in accordance with a predetermined display mode. The display mode processor relieves the central processing unit from video display tasks in a multi-window environment and also supports window-specific attributes such as display mode in addition to window specific color look up tables. This dedicated hardware for video display tasks allows for a more flexible and efficient color display system without sacrificing the overall system performance.

32 Claims, 6 Drawing Sheets

DISPLAY MODE PROCESSOR

CROSS REFERENCE TO RELATED APPLICATION(S)

This is a continuation of application Ser. No. 08/039,551 filed on Mar. 29, 1993, now abandoned, which is, in turn, a continuation of application Ser. No. 07/650,513 filed on Feb. 5, 1991, now abandoned.

BACKGROUND OF THE INVENTION

1. Field of the Invention

The present invention relates to a system and method for mapping video inputs to addresses for color look-up tables, and more particularly, to a system and method for mapping a pixel input to an address of an entry in a window specific color look-up table in accordance with a window-specific display mode.

2. Description of the Prior Art

The image refresh system of raster displays often includes a so-called video color look-up table (also called a color table or color map). In such systems, the color of each pixel in an image is coded by a value which is not usually routed directly to the digital-to-analog converter. Instead, this value is used as an index into the look-up table. A value in the table entry indexed by the pixel value is then used to control the display color for that pixel. Since many color applications do not require all of the available colors in a single picture, the look-up table typically contains only the colors necessary to render the image. This technique thus saves memory space in the color display device.

FIG. 1 illustrates the operation of a prior art color look-up table of the type just described. As shown, a part of the memory is organized into frame buffer 100 where color information for each pixel 102 is stored. The color information for pixel 102 in frame buffer 100 represents an index 104 to a particular color in the color look-up table 106. In the example, index 104 has a value of "67" which points to a table entry 108 in color look-up table 106 at address "67". As shown, the table entry value 108 indexed by the index 104 with value "67" actually contains a twelve-bit value "100110100001" which represents the color information for a particular pixel of the display screen. As shown, this table entry value 108 is actually an aggregate of three 4-bit values for red, green, and blue as shown at 110. Each color component value at 110 is used to control one or more color guns 112 which actually render the specified color to a pixel 114 at location $(X_o,Y_o)$ on the CRT display. The above-described color look-up operation is repeated for every pixel on the CRT display until the whole image is rendered.

A single set of color maps is typically addressed for all pixels of the display screen. In other words, in a multi-window environment, each window typically does not have its own set of colors. This is the case because the ability to maintain an independent color look-up table for each window is burdensome for the Central Processing Unit (CPU). Thus, when refreshing images in different windows, window-specific pixel values must be converted to global coordinates for use as indices to the color look-up table containing the actual red, green, and blue values. This is also burdensome for the CPU. It is desired that the color look-up tables be made window-specific to avoid such extra processing. Also, by making the color look-up tables window-specific, independent display modes for each window will be made possible.

The use of different display modes for each window makes possible many new possibilities for the presentation of computer graphics images. For example, in a blending mode one window may allow overlaying of an image over another image in that window while another window may compare respective images. However, such calculations must be better supported by a dedicated piece of hardware so that the CPU can be relieved from these multiple display tasks. Otherwise, system performance degrades too much to make window-specific display modes practical for use in graphics display systems.

Thus, a need exists for a dedicated piece of hardware that supports independent display modes and red, green, and blue color look-up tables for each window in a multi-window environment without burdening the CPU. Such a device should be able to keep track of window-specific attributes and to refresh the window images according to the attributes. Such a device should also be able to map the window-specific pixel values into addresses for window-specific color look-up tables. The present invention has been designed to meet these needs.

SUMMARY OF THE INVENTION

According to the invention, a graphics system having a Display Mode Processor is provided. The Display Mode Processor of the invention maps input data into addresses to window-specific color look-up tables which have color values stored therein for pixels to be displayed within the corresponding display windows of a display device. Such a Display Mode Processor of the invention comprises means for holding window-specific control information for each display window of the display device and means for converting the input data into the addresses to the window-specific color look-up tables in accordance with predetermined display mode conversion schemes specified by the window-specific control information. In a preferred embodiment, the input data comprises frame buffer image data for each display window, window index data specifying which window the image data is to be displayed in, cursor data for a cursor to be displayed in at least one display window and overlay data for an overlay image to be displayed in the at least one display window. The window-specific color look-up tables preferably comprise an image color look-up table and an overlay color look-up table. In addition, the cursor data may be converted by the converting means into addresses to a cursor color look-up table which is common to each display window.

In another embodiment of the invention, the window-specific control information comprises display mode control data for specifying at least one of a plurality of display modes and image data and overlay data enable signals for instructing the converting means to convert only predetermined portions of the image data and overlay data into addresses to the window-specific color look-up tables for display of color data stored therein in the at least one display mode. Preferably, the predetermined display mode conversion schemes convert the input data into addresses to color data in at least one of a plurality of display modes comprising 8-bit indexed; 8-bit monochrome; 3 red, 3 green, 2 blue; 8 red, 8 green, 8 blue; 4 red, 4 green, 4 blue; and 12-bit indexed. In addition, the converting means preferably comprises means for masking the image data, the cursor data and the overlay data in response to the display mode control data and the image data and overlay data enable signals.

Other preferred embodiments of the display mode processor of the invention further comprise a display mode multiplexer for outputting the image data in accordance with the at least one display mode specified by the display mode control data. The converting means may further comprise means responsive to the masking means for resolving display dominance of the cursor data and the overlay data when they correspond to the same display pixel of the display device. The converting means may also comprise an integrating multiplexer responsive to outputs of the dominance resolving means and the display mode multiplexer for generating the addresses to the window-specific color look-up tables.

The invention further includes a method of mapping input data into addresses to window-specific color look-up tables having color values stored therein for pixels to be displayed within the corresponding display windows of a display device. Such a method in accordance with the invention preferably comprises the steps of:

masking input data in accordance with display control data including enable signals for instructing masking means to pass only predetermined portions of the input data;

generating addresses from the predetermined portions of the input data in accordance with one of a plurality of predetermined display mode conversion schemes specified by window-specific control information;

resolving a dominance among a cursor input, an overlay input and an image data input in accordance with the window-specific control information and global control information to select a set of generated addresses; and outputting the resolved address set to the window-specific color look-up tables as an input thereto.

Further details regarding the method of the invention may be found by referring to the following detailed description of the invention.

BRIEF DESCRIPTION OF THE DRAWINGS

The objects and advantages of the invention will become more apparent and more readily appreciated from the following detailed description of the presently preferred exemplary embodiment of the invention taken in conjunction with the accompanying drawings, of which.

DETAILED DESCRIPTION OF THE PRESENTLY PREFERRED EMBODIMENT

A display mode processor in accordance with a presently preferred exemplary embodiment of the invention will be described below with reference to FIGS. 2 through 6 and TABLES 1 through 6. The invention is described as supporting 16 window-specific color look-up tables with 24-bit wide entries. However, it will be recognized by those skilled in the art that the technique of the invention may be used to map a pixel input to an address corresponding to an entry of a different width for a different number of independent color look-up tables whereby the CPU may be relieved from the color look-up operation in accordance with the techniques of the invention. Thus, the description given herein is for exemplary purposes only and is not intended in any way to limit the scope of the invention. All questions regarding the scope of the invention may be resolved by referring to the appended claims.

The Display Mode Processor (DMP) of the invention maps the window, image, overlay and cursor planes of the frame buffer into addresses for the window-specific red, green, and blue color look-up tables. Multiple DMP's can be configured on a display board with each DMP processing one pixel every several nanoseconds. In addition to supporting 16 independent windows and their associated color look-up tables, the DMP may also support separate display modes for each window and provide overlay-cursor detection and control. A color map address counter may also be provided for updating the color maps during the vertical blanking interval of the display device. Such features of the invention will be described in more detail below.

Figure 1:
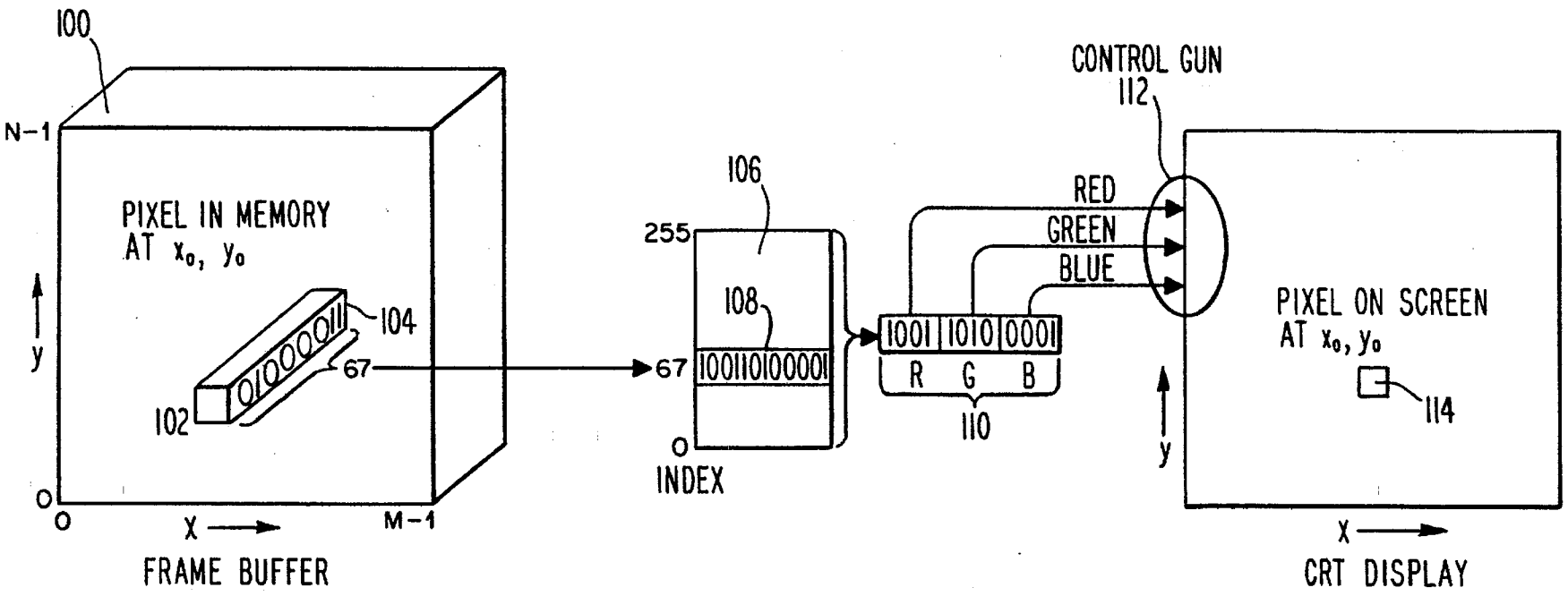
FIG. 1 illustrates a conventional technique for mapping a pixel input value to an address of a corresponding table entry in a color look-up table.
Figure 2:
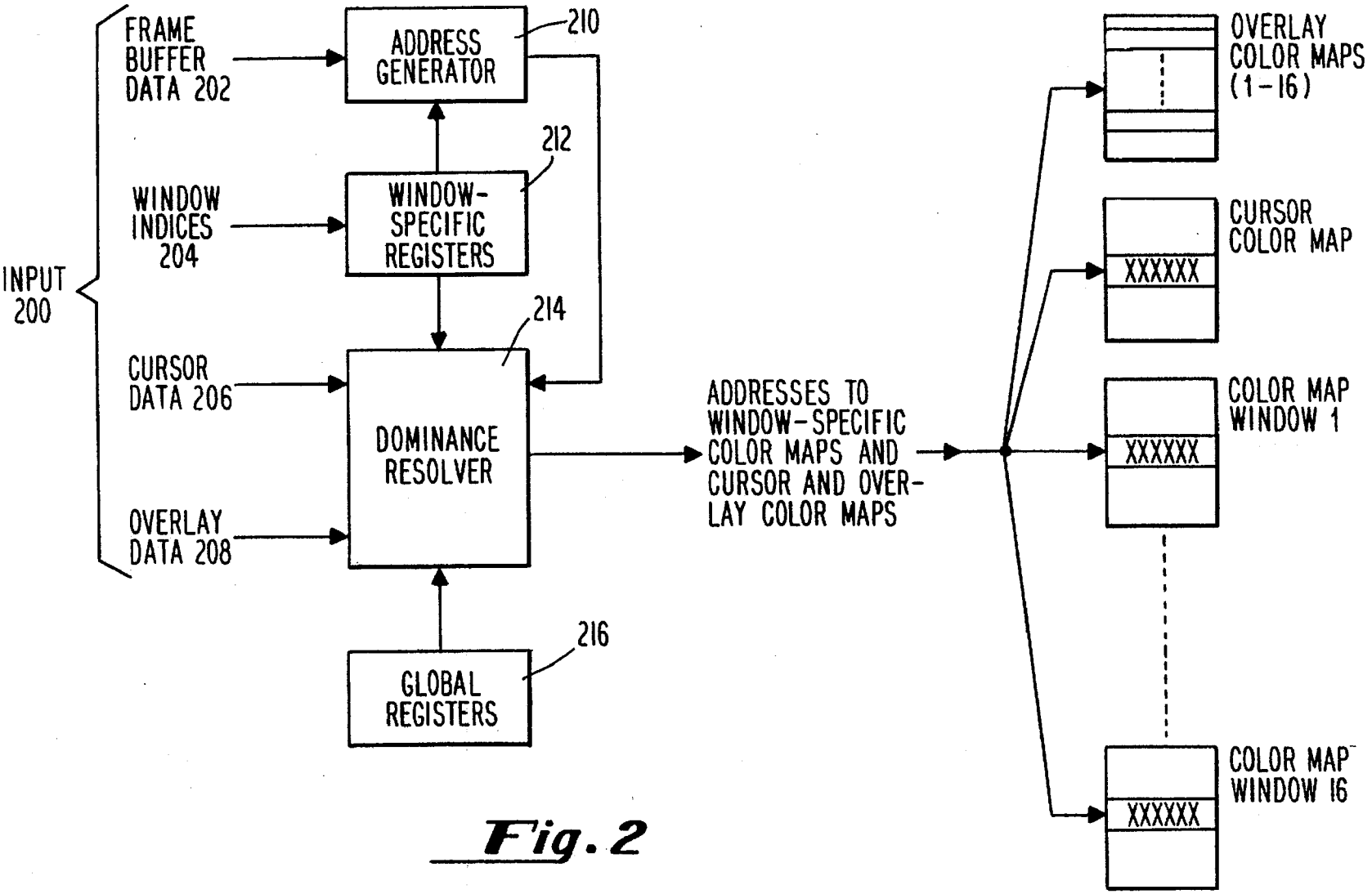
FIG. 2 schematically illustrates a block diagram of the display mode processor of the invention.

FIG. 2 schematically illustrates a block diagram of the current invention. As shown, the pixel input 200 consists of frame buffer or image data 202, window indices 204, cursor data 206 and overlay data 208. The frame buffer data 202 comprises a signal representing a plurality of pixel planes. The input planes of information are converted into addresses for entries in window-specific color look-up tables by address generator 210 in response to window-specific information from window-specific registers 212. As will be described in more detail below with respect to FIG. 3, the addresses are generated in accordance with one of a predetermined number of algorithms, where the algorithm selection is specified by window-specific registers 212. Window indices 204 specify which set of window-specific registers 212 to use. That is, each input pixel belongs to a window that is referenced by window indices 204.

The cursor data 206 and/or overlay data 208 may be superimposed on the same pixel represented by the frame buffer data 202. Thus, if non-transparent cursor data 206 and overlay data 208 are superimposed over each other or over the pixel data, dominance among the cursor, overlay and frame buffer data must be resolved. Dominance resolver 214 determines this dominance according to inputs from window-specific registers 212 and global registers 216. For example, the cursor may be given priority with the overlay second and the frame buffer data having the least priority. The output of dominance resolver 214 is then used to address the window-relative color maps as well as the cursor and overlay color maps.

Each window has its own set of control information stored in window-specific registers 212. Global registers 216, on the other hand, are not window-specific and control operation of the display mode processor independent of window indices 204. In addition, while the cursor has one color look-up table for all windows, each window preferably has its own color look-up table for overlays as well as for the input data.

Figure 3:
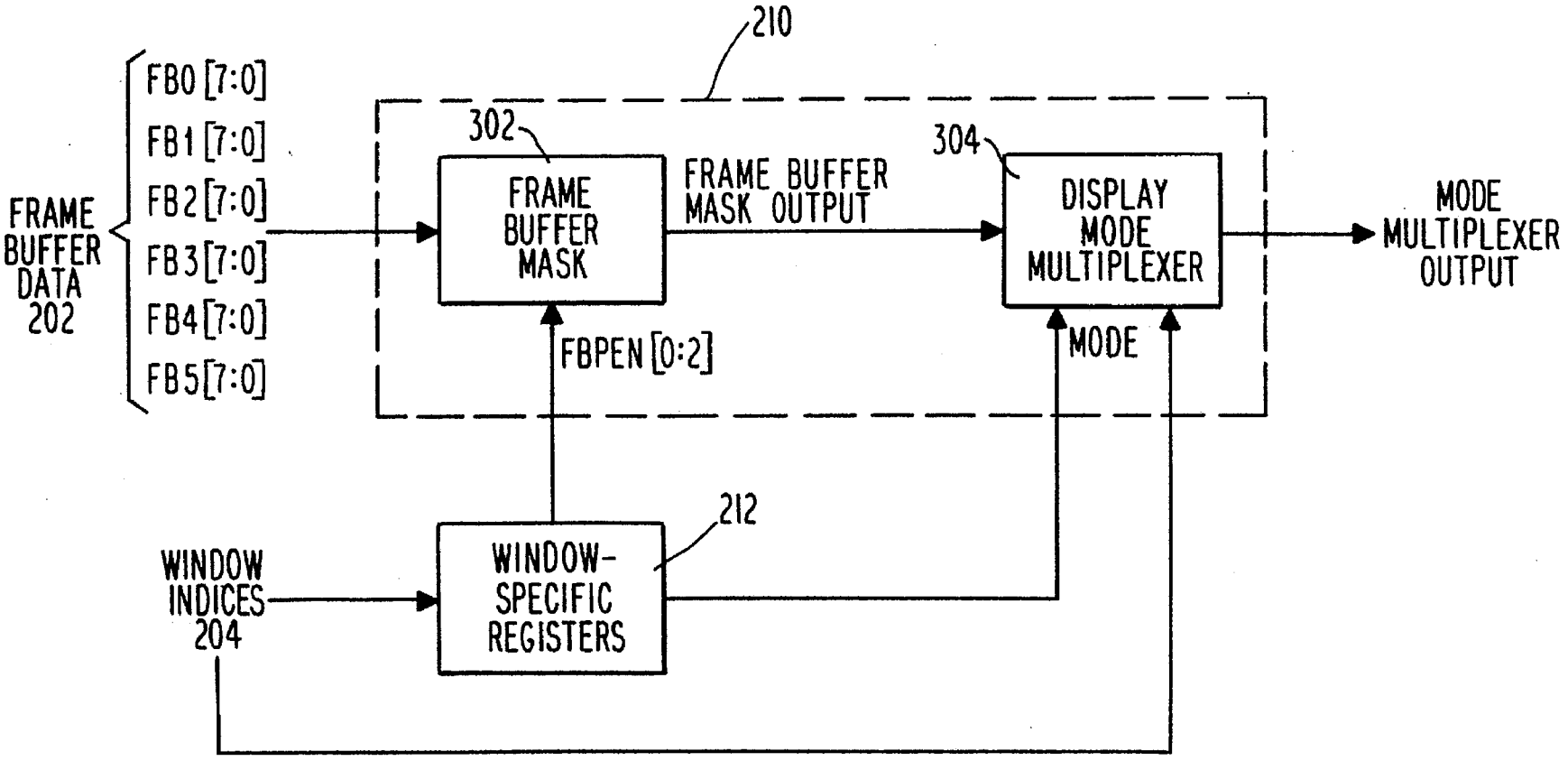
FIG. 3 schematically illustrates a block diagram of the part of the address generator of the embodiment of FIG. 2 which determines the mode multiplexer output from the frame buffer and window index inputs.

FIG. 3 is a schematic diagram illustrating address generator 210 in more detail. As shown, 48-bit planes of frame buffer data 202 are subdivided into six 8-bit planes FB0 through FB5 and provided as inputs into address generator 210. Frame buffer mask 302 masks the frame buffer data 202 according to window-specific FBPEN[0:2] data (Frame Buffer Plane Enable) from window-specific registers 212. In other words, the window-specific data is used to select at least one of the six 8-bit planes FB0–FB5 for output to display mode multiplexer 304, which, in turn, receives mode data from window-specific registers 212 and window indices 204. Window-specific registers 212 are preferably addressed by an integer multiple of 16 times the window ID plus an offset to a particular register. For example, window zero uses addresses "0" through "7" while window two uses addresses "32" through "39". Register addresses are thus defined as a function of their window ID. Within each set of window-specific registers 212, offsets to particular registers are respectively 0 for MODE (which controls the display mode), 1 for FBPEN2 (which enables FB2[7:0] and FB5[7:0]), 2 for FBPEN1 (which enables FBI[7:0] and FB4[7:0]), and 3 for FBPEN0 (which enables FB0[7:0] and FB3[7:0]). As a result of this masking, only enabled planes specified in the FBPEN[0:2] registers are further processed for the address generation. Thus, the frame buffer mask 302 output represents selected planes which are fed into the display mode multiplexer 304 and processed according to the FBPEN register values and the values in the window-specific MODE register to generate mode multiplexer output addresses as an output of the address generator 210.

The output addresses from address generator 210 form 4 groups. Namely, the MODE addresses form the 5 most significant bits for all of the color look-up entry addresses (MSO), while the data in FBPEN[0:2] registers respectively form the 8 least significant bits for the red color look-up table (RMO), the 8 least significant bits for the green color look-up table (GMO), and the 8 least significant bits for the blue color look-up table (BMO). The combination of MSO and either RMO, GMO or BMO renders a complete entry address in the color look-up table for a particular window. However, in certain display modes not all 8 least significant bits are used.

TABLES 1, 2, 3 and 4 respectively show examples of different display modes in accordance with the values of MODE[0:2], FBPEN0[0:7], FBPEN1[0:7], FBPEN2[0:7], MSO[0:4], RMO[0:7], GMO[0:7] and BMO[0:7]. As shown, a combination of MODE and FBPEN registers determines how the window indices 204 (WPI[0:3]) and frame buffer data 202 (FB0–FB5) are converted into the mode multiplexer output addresses for different display modes. The preferred embodiment of the invention supports six display modes which include 8-bit index, 8-bit monochrome, and 3 red, 3 green, 2 blue (3:3:2) (TABLE 1); 8:8:8 (TABLE 2); 4:4:4 (TABLE 3) and 12-bit index modes (TABLE 4). These display modes are implemented by the conversion methods illustrated in the corresponding table. For example, TABLE 1 shows the conversion method for the 8-bit index, 8-bit monochrome and 3:3:2 modes. The top of the tables show what values need to be in the current window's registers and the bottom of the tables show the value of the color map address lines. Although the conversion method is the same among the three modes, since the color look-up tables are loaded differently according to the selected mode, the generated addresses point to different color values.

TABLE 1

| | 8 Bit Index, 6 Bit Monochrome, & 3:3:2 | | | | | |
|---|---|---|---|---|---|---|
| | Buffer 0 | Buffer 1 | Buffer 2 | Buffer 3 | Buffer 4 | Buffer 5 |
| MODE[2:0] | (000) | (000) | (000) | (100) | (100) | (100) |
| FBPEN0 | (11111111) | (00000000) | (00000000) | (11111111) | (00000000) | (00000000) |
| FBPEN1 | (00000000) | (11111111) | (00000000) | (00000000) | (11111111) | (00000000) |
| FBPEN2 | (00000000) | (00000000) | (11111111) | (00000000) | (00000000) | (11111111) |
| MSO[4] | 0 | 0 | 0 | 0 | 0 | 0 |
| MSO[3] | WPI[3] | WPI[3] | WPI[3] | WPI[3] | WPI[3] | WPI[3] |
| MSO[2] | WPI[2] | WPI[2] | WPI[2] | WPI[2] | WPI[2] | WPI[2] |
| MSO[1] | WPI[1] | WPI[1] | WPI[1] | WPI[1] | WPI[1] | WPI[1] |
| MSO[0] | WPI[0] | WPI[0] | WPI[0] | WPI[0] | WPI[0] | WPI[0] |
| RMO[7] | FB0[7] | FB1[7] | FB2[7] | FB3[7] | FB4[7] | FB5[7] |
| RMO[6] | FB0[6] | FB1[6] | FB2[6] | FB3[6] | FB4[6] | FB5[6] |
| RMO[5] | FB0[5] | FB1[5] | FB2[5] | FB3[5] | FB4[5] | FB5[5] |
| RMO[4] | FB0[4] | FB1[4] | FB2[4] | FB3[4] | FB4[4] | FB5[4] |
| RMO[3] | FB0[3] | FB1[3] | FB2[3] | FB3[3] | FB4[3] | FB5[3] |
| RMO[2] | FB0[2] | FB1[2] | FB2[2] | FB3[2] | FB4[2] | FB5[2] |
| RMO[1] | FB0[1] | FB1[1] | FB2[1] | FB3[1] | FB4[1] | FB5[1] |
| RMO[0] | FB0[0] | FB1[0] | FM2[0] | FB3[0] | FB4[0] | FB5[0] |
| GMO[7] | FB0[7] | FB1[7] | FB2[7] | FB3[7] | FB4[7] | FB5[7] |
| GMO[6] | FB0[6] | FB1[6] | FB2[6] | FB3[6] | FB4[6] | FB5[6] |
| GMO[5] | FB0[5] | FB1[5] | FB2[5] | FB3[5] | FB4[5] | FB5[5] |
| GMO[4] | FB0[4] | FB1[4] | FB2[4] | FB3[4] | FB4[4] | FB5[4] |
| GMO[3] | FB0[3] | FB1[3] | FB2[3] | FB3[3] | FB4[3] | FB5[3] |
| GMO[2] | FB0[2] | FB1[2] | FB2[2] | FB3[2] | FB4[2] | FB5[2] |
| GMO[1] | FB0[1] | FB1[1] | FB2[1] | FB3[1] | FB4[1] | FB5[1] |
| GMO[0] | FB0[0] | FB1[0] | FB2[0] | FB3[0] | FB4[0] | FB5[0] |
| BMO[7] | FB0[7] | FB1[7] | FB2[7] | FB3[7] | FB4[7] | FB5[7] |
| BMO[6] | FB0[6] | FB1[6] | FB2[6] | FB3[6] | FB4[6] | FB5[6] |
| BMO[5] | FB0[5] | FB1[5] | FB2[5] | FB3[5] | FB4[5] | FB5[5] |
| BMO[4] | FB0[4] | FB1[4] | FB2[4] | FB3[4] | FB4[4] | FB5[4] |
| BMO[3] | FB0[3] | FB1[3] | FB2[3] | FB3[3] | FB4[3] | FB5[3] |
| BMO[2] | FB0[2] | FB1[2] | FB2[2] | FB3[2] | FB4[2] | FB5[2] |
| BMO[1] | FB0[1] | FB1[1] | FB2[1] | FB3[1] | FB4[1] | FB5[1] |
| BMO[0] | FB0[0] | FB1[0] | FB2[0] | FB3[0] | FB4[0] | FB5[0] |

TABLE 2

| | 8:8:8 | |
|---|---|---|
| MODE[2:0] | Buffer 0 (001) | Buffer 1 (101) |
| FBPEN0 | (11111111) | (11111111) |
| FBPEN1 | (11111111) | (11111111) |
| FBPEN2 | (11111111) | (11111111) |
| MSO[4] | 0 | 0 |
| MSO[3] | WPI[3] | WPI[3] |
| MSO[2] | WPI[2] | WPI[2] |
| MSO[1] | WPI[1] | WPI[1] |
| MSO[0] | WPI[0] | WPI[0] |
| RMO[7] | FB2[7] | FB5[7] |
| RMO[6] | FB2[6] | FB5[6] |
| RMO[5] | FB2[5] | FB5[5] |
| RMO[4] | FB2[4] | FB5[4] |
| RMO[3] | FB2[3] | FB5[3] |
| RMO[2] | FB2[2] | FB5[2] |
| RMO[1] | FB2[1] | FB5[1] |
| RMO[0] | FB2[0] | FB5[0] |
| GMO[7] | FB1[7] | FB4[7] |
| GMO[6] | FB1[6] | FB4[6] |
| GMO[5] | FB1[5] | FB4[5] |
| GMO[4] | FB1[4] | FB4[4] |
| GMO[3] | FB1[3] | FB4[3] |
| GMO[2] | FB1[2] | FB4[2] |
| GMO[1] | FB1[1] | FB4[1] |
| GMO[0] | FB1[0] | FB4[0] |
| BMO[7] | FB0[7] | FB3[7] |
| BMO[6] | FB0[6] | FB3[6] |
| BMO[5] | FB0[5] | FB3[5] |
| BMO[4] | FB0[4] | FB3[4] |
| BMO[3] | FB0[3] | FB3[3] |
| BMO[2] | FB0[2] | FB3[2] |
| BMO[1] | FB0[1] | FB3[1] |
| BMO[0] | FB0[0] | FB3[0] |

TABLE 3

| | 4:4:4 | | | |
|---|---|---|---|---|
| MODE[2:0] | Buffer 0 (001) | Buffer 1 (001) | Buffer 2 (101) | Buffer 3 (101) |
| FBPEN0 | (00001111) | (11110000) | (00001111) | (11110000) |
| FBPEN1 | (00001111) | (11110000) | (00001111) | (11110000) |
| FBPEN2 | (00001111) | (11110000) | (00001111) | (11110000) |
| MSO[4] | 0 | 0 | 0 | 0 |
| MSO[3] | WPI[3] | WPI[3] | WPI[3] | WPI[3] |
| MSO[2] | WPI[2] | WPI[2] | WPI[2] | WPI[2] |
| MSO[1] | WPI[1] | WPI[1] | WPI[1] | WPI[1] |
| MSO[0] | WPI[0] | WPI[0] | WPI[0] | WPI[0] |
| RMO[7] | 0 | FB2[7] | 0 | FB5[7] |
| RMO[6] | 0 | FB2[6] | 0 | FB5[6] |
| RMO[5] | 0 | FB2[5] | 0 | FB5[5] |
| RMO[4] | 0 | FB2[4] | 0 | FB5[4] |
| RMO[3] | FB2[3] | 0 | FB5[3] | 0 |
| RMO[2] | FB2[2] | 0 | FB5[2] | 0 |
| RMO[1] | FB2[1] | 0 | FB5[1] | 0 |
| RMO[0] | FB2[0] | 0 | FB5[0] | 0 |
| GMO[7] | 0 | FB1[7] | 0 | FB4[7] |
| GMO[6] | 0 | FB1[6] | 0 | FB4[6] |
| GMO[5] | 0 | FB1[5] | 0 | FB4[5] |
| GMO[4] | 0 | FB1[4] | 0 | FB4[4] |
| GMO[3] | FB1[3] | 0 | FB4[3] | 0 |
| GMO[2] | FB1[2] | 0 | FB4[2] | 0 |
| GMO[1] | FB1[1] | 0 | FB4[1] | 0 |
| GMO[0] | FB1[0] | 0 | FB4[0] | 0 |
| BMO[7] | 0 | FB0[7] | 0 | FB3[7] |
| BMO[6] | 0 | FB0[6] | 0 | FB3[6] |
| BMO[5] | 0 | FB0[5] | 0 | FB3[5] |
| BMO[4] | 0 | FB0[4] | 0 | FB3[4] |
| BMO[3] | FB0[3] | 0 | FB3[3] | 0 |
| BMO[2] | FB0[2] | 0 | FB3[2] | 0 |

TABLE 3-continued

| | 4:4:4 | | | |
|---|---|---|---|---|
| MODE[2:0] | Buffer 0 (001) | Buffer 1 (001) | Buffer 2 (101) | Buffer 3 (101) |
| FBPEN0 | (00001111) | (11110000) | (00001111) | (11110000) |
| FBPEN1 | (00001111) | (11110000) | (00001111) | (11110000) |
| FBPEN2 | (00001111) | (11110000) | (00001111) | (11110000) |
| BMO[1] | FB0[1] | 0 | FB3[1] | 0 |
| BMO[0] | FB0[0] | 0 | FB3[0] | 0 |

TABLE 4

| | 12 Bit Index | | | |
|---|---|---|---|---|
| MODE[2:0] | Buffer 0 (010) | Buffer 1 (010) | Buffer 2 (110) | Buffer 3 (110) |
| FBPEN0 | (00001111) | (11110000) | (00001111) | (11110000) |
| FBPEN1 | (00001111) | (11110000) | (00001111) | (11110000) |
| FBPEN2 | (00001111) | (11110000) | (00001111) | (11110000) |
| MSO[4] | 1 | 1 | 1 | 1 |
| MSO[3] | FB2[3] | FB2[7] | FB5[3] | FB5[7] |
| MSO[2] | FB2[2] | FB2[6] | FB5[2] | FB5[6] |
| MSO[1] | FB2[1] | FB2[5] | FB5[1] | FB5[5] |
| MSO[0] | FB2[0] | FB2[4] | FB5[0] | FB5[4] |
| RMO[7] | FB1[3] | FB1[7] | FB4[3] | FB4[7] |
| RMO[6] | FB1[2] | FB1[6] | FB4[2] | FB4[6] |
| RMO[5] | FB1[1] | FB1[5] | FB4[1] | FB4[5] |
| RMO[4] | FB1[0] | FB1[4] | FB4[0] | FB4[4] |
| RMO[3] | FB0[3] | FB0[7] | FB3[3] | FB3[7] |
| RMO[2] | FB0[2] | FB0[6] | FB3[2] | FB3[6] |
| RMO[1] | FB0[1] | FB0[5] | FB3[1] | FB3[5] |
| RMO[0] | FB0[0] | FB0[4] | FB3[0] | FB3[4] |
| GMO[7] | FB1[3] | FB1[7] | FB4[3] | FB4[7] |
| GMO[6] | FB1[2] | FB1[6] | FB4[2] | FB4[6] |
| GMO[5] | FB1[1] | FB1[5] | FB4[1] | FB4[5] |
| GMO[4] | FB1[0] | FB1[4] | FB4[0] | FB4[4] |
| GMO[3] | FB0[3] | FB0[7] | FB3[3] | FB3[7] |
| GMO[2] | FB0[2] | FB0[6] | FB3[2] | FB3[6] |
| GMO[1] | FB0[1] | FB0[5] | FB3[1] | FB3[5] |
| GMO[0] | FB0[0] | FB0[4] | FB3[0] | FB3[4] |
| BMO[7] | FB1[3] | FB1[7] | FB4[3] | FB4[7] |
| BMO[6] | FB1[2] | FB1[6] | FB4[2] | FB4[6] |
| BMO[5] | FB1[1] | FB1[5] | FB4[1] | FB4[5] |
| BMO[4] | FB1[0] | FB1[4] | FB4[0] | FB4[4] |
| BMO[3] | FB0[3] | FB0[7] | FB3[3] | FB3[7] |
| BMO[2] | FB0[2] | FB0[6] | FB3[2] | FB3[6] |
| BMO[1] | FB0[1] | FB0[5] | FB3[1] | FB3[5] |
| BMO[0] | FB0[0] | FB0[4] | FB3[0] | FB3[4] |

Figure 4:
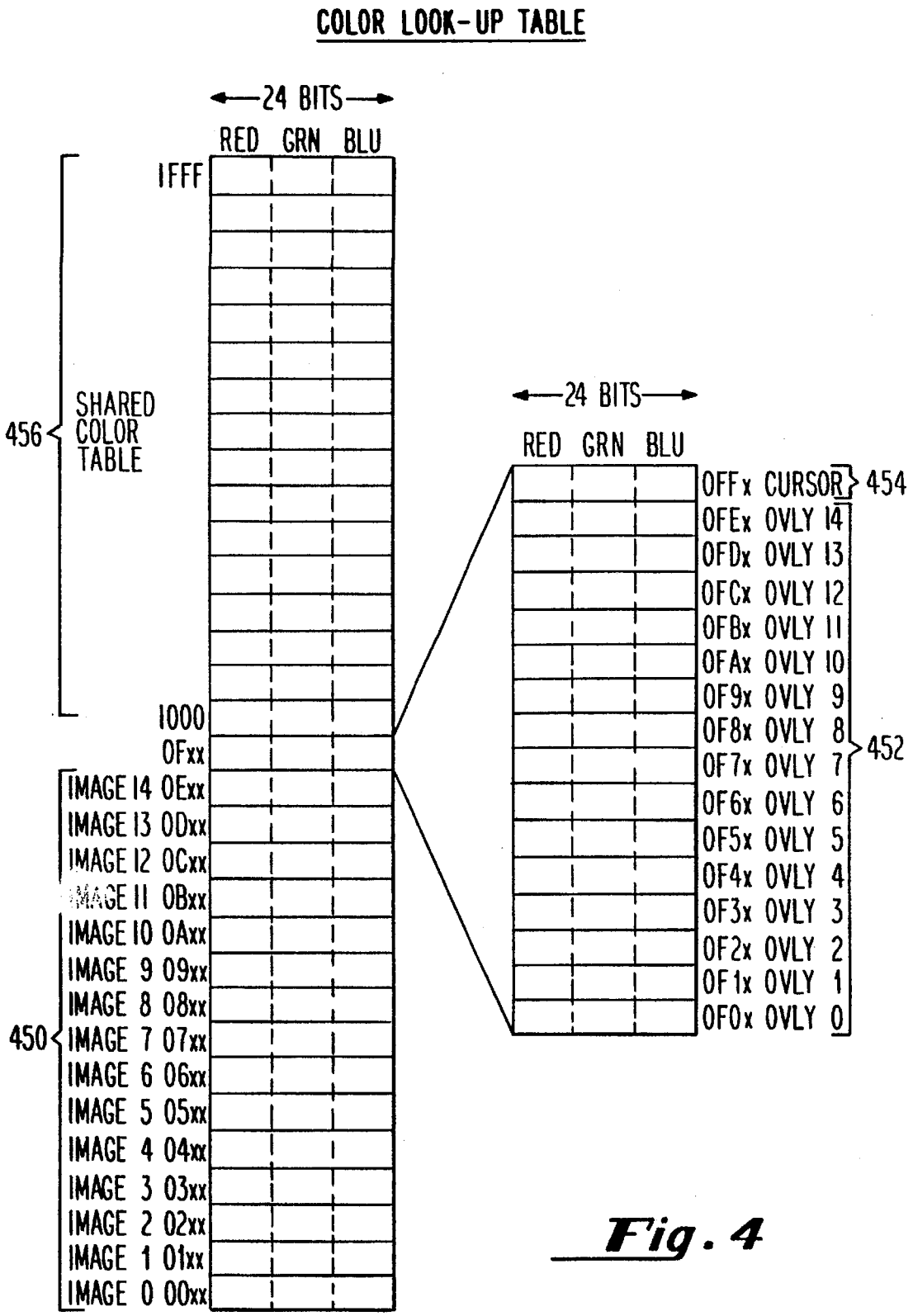
FIG. 4 illustrates a preferred embodiment of the color look-up table format for the display mode processor of the embodiment of FIG. 2.

The actual RGB color map for each window preferably has 8k locations. As noted above, the 5 most significant bits of the address thereto comes from MSO[0:4], while the 8 least significant bits come from RMO[0:7], GMO[0:7] and BMO[0:7], respectively. The first 4K block of color look-up table memory is preferably formatted as shown in FIG. 4. Memory from $(0000)_{16}$ to $(0EFF)_{16}$ is divided into fifteen 256×24 bit RGB image color look-up tables 450. Memory from $(0F00)_{16}$ to $(0FEF)_{16}$ is divided into fifteen 16×24 bit RGB overlay color look-up tables 452. A single image and overlay color map is thus assigned to each window index. Memory from $(0FF0)_{16}$ to $(0FFF)_{16}$ is the 16×24 bit RGB cursor color look-up table 454. The final block of memory, from $(1000)_{16}$ to $(1FFF)_{16}$, is the 4K×24 bit image color look-up table 456 that is shared by all windows that are in the 12-bit indexed mode.

The reader will note that only 15 windows are illustrated for the embodiment of FIG. 4. In that embodiment, the sixteenth window is not a full function window. As shown, the 256 location image color map for this window falls on the section of memory reserved for the overlay and cursor color maps. Similarly, the 16 location overlay color map falls on the section of memory reserved for the cursor color map. Nevertheless, the sixteenth window can be used by allowing the cursor to use only 4 of the reserved 16 colors in the cursor color map and let an internal terminal emulator (ITE) use 8 locations therein. The ITE can access the reserved colors by using the overlay planes in the sixteenth window.

In the 8-bit index mode, each of the 16 tables is loaded with any 256 user-defined color values. On the other hand, in the 8-bit monochrome mode, all 16 red, green and blue tables are loaded with values which indicate only different levels of monochromatic intensity. The 3:3:2 mode has a limited ability to load different color values since only 3 of the 8 least significant bits are used to generate red and green color look-up table addresses and 2 bits for blue color look-up table addresses. Thus, in the 3:3:2 mode, 8 user-defined color values can be loaded for red and green color look-up tables, while only 4 color values can be loaded in the blue color look-up table. For example, if the color look-up tables are loaded according to the 8-bit index mode and the window-specific MODE, FBPEN0, FBPEN1 and FBPEN2 registers respectively contain "000", "11111111", "00000000", and "00000000" as shown in the first column of TABLE 1, MSO, RMO, GMO and BMO output addresses are respectively WPI[0:3], FB0[0:7], FB0[0:7] and FB0 [0:7]. The most significant bit of the MSO output is initialized to be zero. The MSO address is combined with RMO, GMO and BMO addresses to form complete color look-up table entry 13-bit addresses. As noted above, in the 8-bit index, 8-bit monochrome or 3:3:2 mode, the output addresses for the red, green and blue color look-up table entries for a given input are the same; however, the color values loaded in the color maps are different.

TABLE 2 shows the display mode conversion method for the 8:8:8 display mode. In this mode, each of the 16 tables is loaded with any 256 user-defined color values. As described above, the window-specific registers MODE and FBPEN[0:2] registers determine the output addresses. In this mode, however, the output addresses for the red, green and blue color look-up table entries are independent and can be different from each other for the same MODE and FBPEN register input. As shown, the most significant bit of the MSO output is initialized to be zero, and the MSO address is combined with the RMO, GMO and BMO addresses to form complete color look-up table entry 13-bit addresses.

TABLE 3 shows the display mode conversion method for the 4:4:4 display mode. In this mode, the output addresses are independent; however, only 4 bits are used for each color look-up table entry. These 4 bits are either the least or the most significant 4 bits, and the other 4 bits are initialized to zeros. The most significant bit of MSO is also initialized to zero, and the MSO address is combined with the RMO, GMO and BMO addresses to form complete color look-up table entry 13-bit addresses. Since only 4 bits are used per color table, only 16 user-defined color values are loaded per color.

TABLE 4 shows the display mode conversion method for the 12-bit index display mode. Although the same inputs, MODE and FBPEN registers are used to determine outputs, the most significant bit of MSO is set to one. Thus, when the MSO address is combined with either the RMO, GMO or BMO addresses, a complete address for the color look-up table entries is within the shared color table region 456 of FIG. 4.

The mode multiplexer output of the display mode multiplexer 304 in FIG. 3 is not always the final color look-up table entry address. This is because a cursor and/or overlay can be superimposed on any of the frame buffer data 202. In order to resolve dominance among the cursor, overlay and frame buffer data on every clock cycle, the current invention concurrently processes 4 planes of the cursor plane data 206 and overlay plane data 208 as shown in FIG. 5 while the frame buffer data 202 is being processed as described above with respect to FIG. 3.

Figure 5:
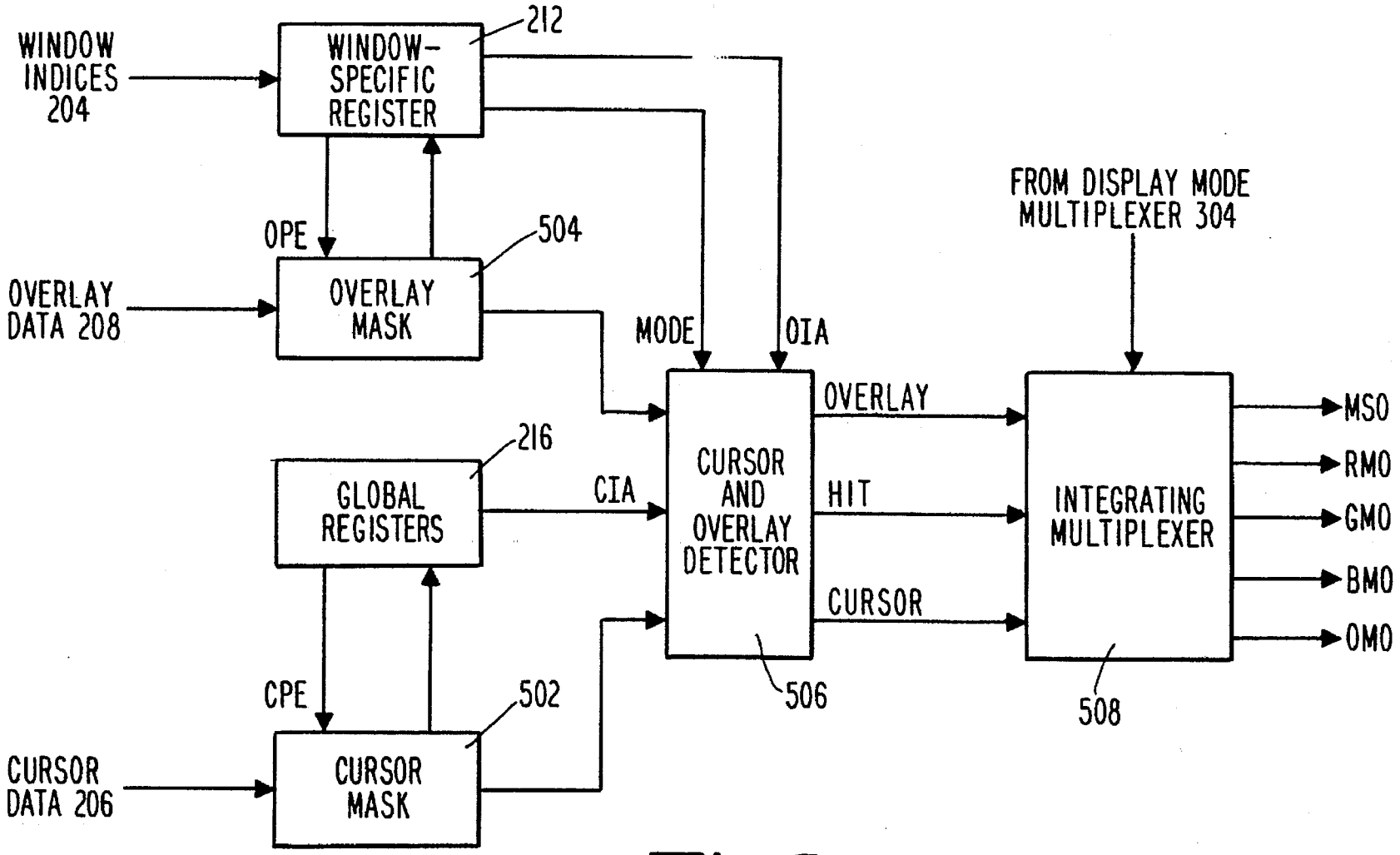
FIG. 5 schematically illustrates a block diagram of the part of the dominance resolver of the embodiment of FIG. 2 which determines dominance among the cursor, overlay, and frame buffer inputs.

As shown in FIG. 5, the cursor data 206 is masked at the cursor mask 502 in accordance with the 4-bit cursor plane enable (CPE) output from global registers 216. CPE is used by cursor mask 502 to select specified planes for further processing. For example, to pass all of the planes, CPE must be $(1111)_2$. As noted above, since there is one cursor for all windows, the cursor information is global among the windows. The cursor mask 502 output indicates an index to the cursor color look-up table 454 entry. Since there are four bits in the cursor plane input 206, the cursor mask output ranges in value from 0 to 15. If cursor mask output is zero, no bit in the CIA register is set to one and the cursor is transparent. Transparency of cursor index values from 0 to 7 is controlled by the corresponding bits 0 through 7 of a cursor index active register (C1A0) of the global registers 216, while the value from 8 to 15 is controlled by the corresponding bits 0 through 7 of a second cursor index active register (CIA1) of the global register 216. When the cursor or overlay index is active (dominant), a table entry address is generated. The two left columns of TABLE 5 show how the table entry addresses for red, green and blue color look-up tables are generated. The four most significant bits in RMO, GMO and BMO are set to $(1111)_2$, while the five most significant bits in MSO for each color look-up table are set to "01111". The MSO address is combined with the RMO, GMO and BMO addresses to form complete color look-up table entry 13-bit addresses as before.

TABLE 5

| Active Cursor Index | | Active Overlay Index | |
|---|---|---|---|
| Output | Value | Output | Value |
| MSO[4:0] | (01111) | MSO[4:0] | (01111) |
| RMO[7:4] | (1111) | RMO[7:4] | WPI[3:0] |
| RMO[3:0] | CPI[3:0] | RMO[3:0] | OPI[3:0] |
| GMO[7:4] | (1111) | GMO[7:4] | WPI[3:0] |
| GMO[3:0] | CPI[3:0] | GMO[3:0] | OPI[3:0] |
| BMO[7:4] | (1111) | BMO[7:4] | WPI[3:0] |
| BMO[3:0] | CPI[3:0] | BMO[3:0] | OPI[3:0] |
| OMO[7:4] | (1111) | OMO[7:4] | WPI[3:0] |
| OMO[3:0] | CPI[3:0] | OMO[3:0] | OPI[3:0] |
| BDO | (1) | BDO | (1) |

The overlay plane data 208 is similarly masked at overlay mask 504 in accordance with the overlay plane enable (OPE) output from the window-specific registers 212. OPE is used by overlay mask 504 to select specified planes for further processing. As in the case of cursor dominance, a corresponding bit in the overlay index active (OIA0 or OIA1) registers are set to one to indicate their active status. The actual table entry addresses are generated by WPI and OPI registers as shown in the two right columns in TABLE 5. Again, the 5 most significant bits in MSO for each color look-up table are set to "01111." Since each window has its own color look-up table for overlay, the address generation is different from that for the cursor, for the four most significant bits in RMO, GMO and BMO are now WPI[0:3]. The MSO address is then combined with the RMO, GMO and BMO addresses to form complete color look-up table entry 13-bit addresses.

In addition to the RGB image color look-up table entry addresses, cursor data 206 and overlay data 208 are used to generate entry addresses for the overlay color map shown in FIG. 4. This color look-up table is only used on a display board that has digital image blenders of type described in related U.S. patent application Ser. No. 07/494,031 filed Mar. 14, 1990 by Gengler, et al., entitled "Digital Image Blending on a Per Pixel Basis." The address for this color map comes from OMO[7:0], which is the overlay map entry.

The cursor and overlay dominance must be resolved if both are active for the same frame buffer data 202. As shown in FIG. 5, the overlay index active bits (OIA) and the cursor index active bits (CIA) are fed into the cursor and overlay detector 506 along with the contents of the window-specific MODE register. The most significant bit of the MODE register (MODE[3]) is used to determine which index has priority over the other. For example, if MODE[3] is zero, CIA has priority over OIA. On the other hand, if MODE[3] is one, OIA has priority over CIA. Thus, the cursor and overlay detector 506 outputs a cursor-overlay dominance output which indicates the resolved dominance between the cursor and overlay plane inputs.

To resolve the dominance between the cursor-overlay dominance output and the display mode multiplexer 304 output, these outputs are fed into the integrating multiplexer 508 as shown in FIG. 5. If the cursor-overlay dominance output from cursor and overlay detector 506 is active, integrating multiplexer 508 outputs a color look-up table entry address OMO as shown in TABLE 5 to the output ports. On the other hand, if the cursor-overlay dominance output is not active (i.e., neither cursor nor overlay is superimposed on the frame buffer data), the integrating multiplexer 508 outputs the MSO, RMO, GMO and BMO address values from the display mode multiplexer 304 output.

Figure 6:
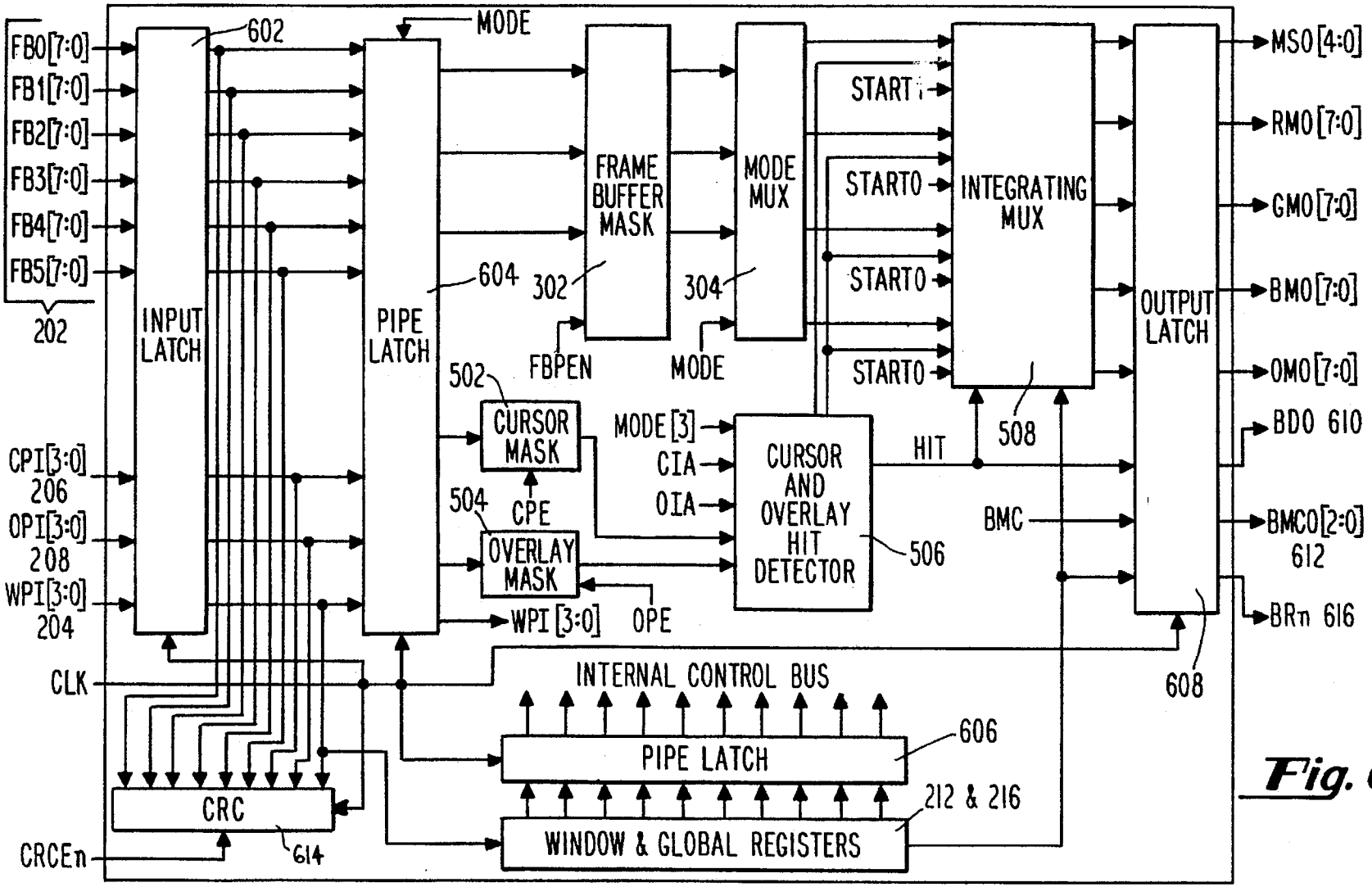
FIG. 6 schematically illustrates a detailed block diagram of the display mode processor of the invention.

FIG. 6 shows an overall block diagram of the Display Mode Processor of the invention. As shown, the frame buffer data 202, cursor data 206, overlay data 208 and window indices 204 are latched by the input latch 602. Master clock input CLK to the DMP runs at a maximum rate of 32.5 MHz for controlling latching. Window-specific registers 212 and global registers 216 are loaded prior to the DMP mapping operation according to window attributes and the environmental setting. The inputs and register contents are then latched respectively in pipe latches 604 and 606. Processing by the frame buffer mask 302, display mode multiplexer 304, cursor mask 502, overlay mask 504, cursor and overlay hit detector 506 and integrating multiplexer 508 then proceeds as described above with respect to FIGS. 2, 3, and 5. The output from the integrating multiplexer 508 is then latched by the output latch 608 so that the output is available through output ports for MSO, RMO, GMO, BMO and OMO.

The Display Mode Processor of the invention also has other capabilities. For example, the DMP may provide preprocessing for a digital image blender of the type referenced above. Although the DMP itself does not blend an image with overlay, it outputs a blender dominance output (BDO) 610 and blend mode control output (BMCO) 612 to control a blender of the type described in the aforementioned related application. A blend mode control (BMC) input from the window-specific registers controls the blending function as described in that application. When no such blenders are used on the display board on which the DMP is placed, the addresses in the MSO, RMO, GMO and BMO ports will fetch the cursor or overlay color value from a respective color look-up table. However, if the blenders are on the display board, then the active BDO (Blender Dominance Output) line will force the blender to pass the color of the cursor or overlay to the display monitor without blending. The cursor or overlay color will come from an overlay color look-up table connected to the OMO port. The cursor/overlay action with the blender is thus similar to that without a blender except that when neither cursor nor overlay is active, the overlay is blended with an image.

The DMP of the invention also preferably has an internal cyclic redundancy code (CRC) generator 614 which runs the frame buffer memory diagnostics. In order to use the CRC generator 614 to check the frame buffer memory, a cyclic redundacy code select (CRCS) register of the global registers 216 must first be loaded with an appropriate value to select which input port signal is to be tested. After CRCS is set, when the enable line CRCEn is low for the frame buffer planes specified by CRCS register, the CRC value from the global registers 216 is calculated on each rising edge of CLK. On the rising edge of CRCEn, the CRC value is buffered in an internal latch and cleared on the next two consecutive CLK cycles. The CRC value can then be read until the next CRC is calculated. TABLE 6 shows a corresponding CRCS value for each input port selected for CRC error checking in a preferred embodiment. This table determines which frame buffer plane is connected to the CRC generator 614. After CRCEn goes low again, the CRC is halted and is read.

TABLE 6

| CRCS VALUE | INPUT PORT SIGNAL SELECTED |
|---|---|
| 0 | FB0[0] |
| 1 | FB0[1] |
| 2 | FB0[2] |
| 3 | FB0[3] |
| 4 | FB0[4] |
| 5 | FB0[5] |
| 6 | FB0[6] |
| 7 | FB0[7] |
| 8 | FB1[0] |
| 9 | FB1[1] |
| 10 | FB1[2] |
| 11 | FB1[3] |
| 12 | FB1[4] |
| 13 | FB1[5] |
| 14 | FB1[6] |
| 15 | FB1[7] |
| 16 | FB2[0] |
| 17 | FB2[1] |
| 18 | FB2[2] |
| 19 | FB2[3] |
| 20 | FB2[4] |
| 21 | FB2[5] |
| 22 | FB2[6] |
| 23 | FB2[7] |
| 24 | FB3[0] |
| 25 | FB3[1] |
| 26 | FB3[2] |
| 27 | FB3[3] |
| 28 | FB3[4] |
| 29 | FB3[5] |
| 30 | FB3[6] |
| 31 | FB3[7] |
| 32 | FB4[0] |
| 33 | FB4[1] |
| 34 | FB4[2] |
| 35 | FB4[3] |
| 36 | FB4[4] |
| 37 | FB4[5] |
| 38 | FB4[6] |
| 39 | FB4[7] |
| 40 | FB5[0] |
| 41 | FB5[1] |
| 42 | FB5[2] |

TABLE 6-continued

| CRCS VALUE | INPUT PORT SIGNAL SELECTED |
|---|---|
| 43 | FB5[3] |
| 44 | FB5[4] |
| 45 | FB5[5] |
| 46 | FB5[6] |
| 47 | FB5[7] |
| 48 | CPI[0] |
| 49 | CPI[1] |
| 50 | CPI[2] |
| 51 | CPI[3] |
| 52 | OPI[0] |
| 53 | OPI[1] |
| 54 | OPI[2] |
| 55 | OPI[3] |
| 56 | WPI[0] |
| 57 | WPI[1] |
| 58 | WPI[2] |
| 59 | WPI[3] |

FIG. 6 also shows how the DMP updates the color look-up tables during the vertical blanking interval of the display device. Two register pairs, START1/START0 and STOP1/STOP0, of the global registers 216 are used for this purpose. START1/START0 and STOP1/STOP0 are used to hold the starting and ending address of a color map block. For example, when a $(1)_2$ is written to a block refresh start (BRS) register (which gives the block refresh start address), of the global registers 216, the starting address of the color map stored in the START1/START0 registers is fed into the integrating multiplexer 508 then outputted to the color maps. On every rising edge of CLK, the START1/START0 registers are incremented until they reach the end of the map address stored in STOP1/STOP0. A block refresh signal BRn 616 is active during refreshing and used to clock data into the color maps during the vertical blanking interval. The BRS register of the global registers 216 is checked to determine when the block refresh is finished.

The display mode processor of the invention thus provides hardware support for up to 16 windows, although the system could be readily modified to allow for more windows. Each window is assigned an internal control (window-specific) register 212 which contains information on the window's display mode, blend mode, cursor/overlay dominance, image and overlay plane enables, as well as overlay index transparencies. These registers are preferably organized into a file and indexed by the incoming window planes. Thus, if the DMP sees window plane data "N", the register set defined by index "N" is output to the internal control bus of the chip. As noted above, the DMP supports read or write access to any of these window-specific registers.

Those skilled in the art will readily appreciate that many additional modifications are possible in the exemplary embodiment without materially departing from the novel teachings and advantages of this invention. For example, the invention may be used with modified color map table formats. In addition, although the described embodiment can handle forty-eight planes of image data, an 8-plane or 24-plane system may be designed by simply disconnecting the appropriate FB[0:5] inputs. A 24-plane system so modified will be able to support all display modes with half as many buffers as the 48-plane system described. The only loss in functionality would be that no double buffering would be possible in the 8:8:8 display mode. An 8-plane system, on the other hand, would operate under the 8-bit index, 8-bit monochrome and 3:3:2 modes without buffering. Accordingly, all such modifications are included within the scope of the invention as defined in the following claims.

What is claimed is:

1. A computer graphics system having a display device, comprising:

means for processing input display data for display on said display device;

a window-specific color look-up table for each display window of said display device for storing color values of pixels to be displayed within corresponding display windows of said display device, each window-specific color look-up table having color values stored therein in a format of one of a plurality of display modes for pixels to be displayed within a corresponding display window of said display device;

a display mode processor for mapping said processed input display data into addresses to said window-specific color look-up tables, said display mode processor comprising means, responsive to input window index data specifying which display window of said display device said input display data is to be displayed in, for holding window-specific control information for each display window of said display device and for outputting window specific control information including display mode control data specifying in which of said plurality of display modes the display window selected by said window index data will display said input display data, and means, responsive to said window-specific control information for the selected display window, for converting said processed input display data into an addresses to the window-specific color look-up table corresponding to the selected display window in accordance with a display mode format for the selected display window specified by said window-specific control information; and means for providing to said display device the color values at addresses in said window-specific color look-up tables determined by said display mode processor.

2. A computer graphics system as in claim 1, wherein each window-specific color look-up table of each display window of said display device comprises an image color look-up table and an overlay color look-up table.

3. A computer graphics system as in claim 2, wherein said converting means of said display mode processor receives cursor data which it converts into addresses to a cursor color look-up table which is common to each display window of said display device.

4. A computer graphics system as in claim 1, wherein said window-specific control information further comprises overlay data for an overlay image and cursor data for a cursor to be displayed in the selected display window, and instruction data for instructing said converting means to convert only predetermined portions of said input display data, overlay data and cursor data into said address to said window-specific color look-up table corresponding to the selected display window for display of color data stored therein in said display mode format.

5. A computer graphics system as in claim 4, wherein said display modes comprise 8-bit indexed; 8-bit monochrome; 3 red, 3 green, 2 blue; 8 red, 8 green, 8 blue; 4 red, 4 green, 4 blue; and 12-bit indexed.

6. A computer graphics system as in claim 4, wherein said converting means comprises means for masking said input display data, said cursor data and said overlay data in response to said display mode control data and input display data, overlay data and cursor data enable signals.

7. A computer graphics system as in claim 6, wherein said converting means further comprises a display mode multiplexer for outputting said input display data to the selected display window in accordance with the display mode specified by said display mode control data.

8. A computer graphics system as in claim 7, wherein said converting means further comprises means responsive to said masking means for resolving display dominance of said cursor data and said overlay data when they correspond to the same display pixel of said display device.

9. A computer graphics system as in claim 8, wherein said converting means further comprises an integrating multiplexer responsive to outputs of said dominance resolving means and said display mode multiplexer for generating said address to the window-specific color look-up table corresponding to the selected display window of said display device.

10. A computer graphics system as in claim 9, wherein said integrating multiplexer outputs a window-specific address, a red color map address, a green color map address, a blue color map address and an overlay color map address, said window-specific address forming a most significant bit portion and said red, green and blue color map addresses forming respective least significant bit portions of said address to the window-specific color look-up table corresponding to the selected display window of said display device.

11. A computer graphics system as in claim 1, wherein said holding means of said display mode processor comprises a plurality of window-specific registers organized into a file which is accessed by specifying a window number of the window-specific control information to be accessed.

12. A computer graphics system as in claim 1, further comprising means for refreshing said window-specific color look-up tables during a vertical blanking interval of said display device.

13. A computer graphics system as in claim 1, further comprising a cyclic redundancy code diagnostic tester for testing said processed input display data for read/write errors.

14. A display mode processor which controls the presentation of pixels to a display window of a display device in any of a plurality of display modes, comprising:

a window-specific color look-up table for each display window of said display device in which input display data is to be displayed, each window-specific color look-up table having color values stored therein in a format of one of said plurality of display modes for pixels to be displayed within a corresponding display window of said display device;

means, responsive to input window index data specifying which display window of said display device said input display data is to be displayed in, for holding window-specific control information for each display window of said display device and for outputting window-specific control information including display mode control data specifying in which of said plurality of display modes the display window selected by said window index data will display said input display data; and means, responsive to said window-specific control information for the selected display window, for converting said input display data into an address of the window-specific color look-up table corresponding to the selected display window in accordance with a display mode format specified by said window-specific control information for the selected display window.

15. A display mode processor as in claim 14, wherein each window-specific color look-up table of each display window of said display device comprises an image color look-up table and an overlay color look-up table.

16. A display mode processor as in claim 15, wherein said converting means receives cursor data which it converts into addresses to a cursor color look-up table which is common to each display window of said display device.

17. A display mode processor as in claim 16, wherein said processor further comprises registers having global control information stored therein, said global control information including a cursor enable signal for instructing said converting means to convert only predetermined portions of said cursor data into addresses to said common cursor color look-up table.

18. A display mode processor as in claim 17, wherein said converting means comprises means for masking said cursor data in response to said cursor enable signal.

19. A display mode processor as in claim 14, wherein said window-specific control information further comprises overlay data for an overlay image and cursor data for a cursor to be displayed in the selected display window, and instruction data for instructing said converting means to convert only predetermined portions of said input display data, overlay data and cursor data into said address to said window-specific color look-up table corresponding to the selected display window for display of color data stored therein in said display mode format.

20. A display mode processor as in claim 19, wherein said display modes comprise 8-bit indexed; 8-bit monochrome; 3 red, 3 green, 2 blue; 8 red, 8 green, 8 blue; 4 red, 4 green, 4 blue; and 12-bit indexed.

21. A display mode processor as in claim 19, wherein said converting means comprises means for masking said input display data, said cursor data and said overlay data in response to said display mode control data and input display data, overlay data and cursor data enable signals.

22. A display mode processor as in claim 21, wherein said converting means further comprises a display mode multiplexer for outputting said input display data to the selected display window in accordance with the display mode specified by said display mode control data.

23. A display mode processor as in claim 22, wherein said converting means further comprises means responsive to said masking means for resolving display dominance of said cursor data and said overlay data when they correspond to the same display pixel of said display device.

24. A display mode processor as in claim 23, wherein said converting means further comprises an integrating multiplexer responsive to outputs of said dominance resolving means and said display mode multiplexer for generating said address of the window-specific color look-up table corresponding to the selected display window of said display device.

25. A display mode processor as in claim 24, wherein said integrating multiplexer outputs a window-specific address, a red color map address, a green color map address, a blue color map address and an overlay color map address, said window-specific address forming a most significant bit portion and said red, green and blue color map addresses forming respective least significant bit portions of said address of the window-specific color look-up table corresponding to the selected display window of said display device.

26. A display mode processor as in claim 14, wherein said holding means comprises a plurality of window-specific registers organized into a file which is accessed by specifying a window number of the window-specific control information to be accessed.

27. A display mode processor as in claim 14, further comprising means for refreshing each window-specific color look-up table during a vertical blanking interval of said display device.

28. A display mode processor as in claim 14, further comprising a cyclic redundancy code diagnostic tester for testing said input display data for read/write errors.

29. A method of mapping input display data into an address of a window-specific color look-up table of a display window of a display device in which said input display data is to be displayed, said window-specific color look-up table having color values stored therein in a format of one of a plurality of display modes for pixels to be displayed within said display window of said display device, comprising the steps of:

masking said input display data in accordance with window-specific control data including window index data specifying which display window of said display device said input display data is to be displayed in so as to pass only predetermined portions of said input display data;

generating an address to said window-specific color look-up table of said display window of said display device from said predetermined portions of said input display data in accordance with a display mode format specified by said window specific control data for said display window;

resolving a dominance among a cursor input, an overlay input and said input display data when they correspond to the same address for a pixel in said display window; and outputting the generated address to said window-specific color look-up table of said display window as input thereto in accordance with said display mode format specified by said window-specific control information for said display window.

30. The method of claim 29, wherein said window-specific control data further includes cursor data for a cursor to be displayed in said display window and overlay data for an overlay image to be displayed in said display window.

31. The method of claim 30, wherein said masking step comprises the steps of masking said input display data, said cursor data, and said overlay data in accordance with a display data enable signal, a cursor data enable signal and an overlay data enable signal, respectively.

32. The method of claim 30, wherein the dominance resolving step comprises the steps of first determining the priority between said cursor data and overlay data in accordance with the display mode specified by said window-specific control data and, and based upon the determined dominance, superimposing the data with priority over the data without priority and over said input display data.

* * * * *